US009510115B2

(12) United States Patent
Bern

(10) Patent No.: US 9,510,115 B2
(45) Date of Patent: Nov. 29, 2016

(54) HEARING AID DEVICE USING DUAL ELECTROMECHANICAL VIBRATOR

(71) Applicant: Oticon Medical A/S, Smørum (DK)

(72) Inventor: Bengt Bern, Mölndal (SE)

(73) Assignee: OTICON MEDICAL A/S, Smorum (DK)

( * ) Notice: Subject to any disclaimer, the term of this patent is extended or adjusted under 35 U.S.C. 154(b) by 0 days.

(21) Appl. No.: 14/600,988

(22) Filed: Jan. 20, 2015

(65) Prior Publication Data

US 2015/0208183 A1 Jul. 23, 2015

(30) Foreign Application Priority Data

Jan. 21, 2014 (EP) ..... 14151860

(51) Int. Cl.
*H04R 25/00* (2006.01)
*H04R 1/26* (2006.01)

(52) U.S. Cl.
CPC ..... *H04R 25/65* (2013.01); *H04R 1/26* (2013.01); *H04R 25/606* (2013.01); *H04R 25/405* (2013.01); *H04R 25/554* (2013.01); *H04R 2225/67* (2013.01); *H04R 2460/13* (2013.01)

(58) Field of Classification Search
CPC ..... H04R 1/24; H04R 1/26; H04R 3/005; H04R 25/405; H04R 25/407; H04R 25/554; H04R 25/606; H04R 2225/67; H04R 2460/13; H04R 25/65; A61N 1/36032
USPC ..... 381/312, 317, 326, 182, 186, 401, 402; 600/25; 607/55, 56, 57
See application file for complete search history.

(56) References Cited

U.S. PATENT DOCUMENTS

| | | | | |
|---|---|---|---|---|
| 3,796,839 | A * | 3/1974 | Torn | H04R 1/24 381/182 |
| 4,220,832 | A * | 9/1980 | Nagel | H04R 9/063 381/182 |
| 5,824,022 | A * | 10/1998 | Zilberman | A61N 1/36032 128/903 |
| 6,005,955 | A * | 12/1999 | Kroll | H04R 25/606 381/312 |
| 6,072,885 | A | 6/2000 | Stockham, Jr. et al. | |
| 7,266,208 | B2 * | 9/2007 | Charvin | H04R 25/606 381/322 |
| 7,657,038 | B2 * | 2/2010 | Doclo | G10L 21/0208 379/406.01 |
| 2007/0156011 | A1 | 7/2007 | Westerkull | |
| 2007/0191673 | A1 * | 8/2007 | Ball | H04R 25/606 600/25 |

FOREIGN PATENT DOCUMENTS

| | | |
|---|---|---|
| EP | 1 617 704-2 | 1/2006 |
| EP | 1 871 141 A2 | 12/2007 |
| EP | 2 234 413 A2 | 9/2010 |
| WO | WO 99/08476 A2 | 2/1999 |
| WO | WO 2008/089914 A1 | 7/2008 |
| WO | WO 2009/121119 A1 | 10/2008 |

* cited by examiner

*Primary Examiner* — Huyen D Le
(74) *Attorney, Agent, or Firm* — Birch, Stewart, Kolasch & Birch, LLP

(57) ABSTRACT

According to an embodiment, a transcutaneous active bone anchored hearing aid device is disclosed. The transcutaneous active bone anchored hearing aid device comprises an audio processor comprising means for being externally worn by a hearing aid user and an implantable part comprising transducer means for providing a structure-borne acoustic signal to the skull bone of the hearing aid user. The implantable part comprises a low frequency vibrator and a high frequency vibrator arranged next to each other.

15 Claims, 4 Drawing Sheets

HEARING AID DEVICE USING DUAL ELECTROMECHANICAL VIBRATOR

FIELD

The present disclosure generally relates to a transcutaneous active bone anchored hearing aid device. The present disclosure more particularly relates to a transcutaneous active bone anchored hearing aid device that comprises a dual electromechanical vibrator.

PRIOR ART

Today's percutaneous transducers bone anchored systems has limited maximum force output. One of the limitations for the percutaneous systems relates to the use of the single transducer. In percutaneous bone anchored hearing system, it is custom to use a single transducer that which is optimized to work over the whole hearing frequency range (about 200 Hz-8 kHz).

Further in a transcutaneous bone anchored system that applies a inductive link to transfer energy and signal through the skin (same as cochlear implants), it is an crucial limitation that the transducer as in the percutaneous case is associated to a significant loss of energy related to the signals transferred in the inductive link. The energy loss in such inductive link is typically around 10 dB.

When going from percutaneous to a transcutaneous bone conductor system there are many challenges. The use of an implant comprising the vibrator under the skin requires the use of an inductive link, of the type that is used in cochlear implants, to transfer the signal and energy through the skin.

The energy transfer is very inefficient and there is a risk of losing about 10 dBs of energy. Because of the energy loss a percutaneous system will always perform better than a transcutaneous system if the same type of vibrator is used (on the inside as the outside of the skin).

EP 1617704 A2 discloses a moving armature receiver for a hearing aid. The moving armature receiver has at least two drive coils adapted to be driven by separate drive signal across different frequency ranges by using a frequency dividing network adapted to split an audio input signal into a first audio signal and a second audio signal of predetermined different frequency ranges.

WO 9908476 A2 discloses an implantable hearing system comprising a plurality of electrical-to-mechanical transducers adapted to be placed in a middle ear. The hearing system comprises a signal driver for producing a first signal and a second signal. The hearing system moreover comprise a first and second electrical-to-mechanical transducers having respective first and second mechanical vibration frequency responses. These transducers are adapted to be coupled to an inner ear, thereby forming a combined output mechanical vibration comprising a superposition of the first and second mechanical vibration frequency responses.

EP 1871141 A2 discloses a hearing aid having two physically separate receivers, one for outputting low frequency acoustic sounds and another for outputting high frequency acoustic sounds. The low frequency receiver's output port is connected to a tube in which the high frequency receiver is inserted. At the output of the high frequency receiver, the low frequency and high frequency acoustic sounds are combined to form an acoustic signal that is transmitted to the ear canal.

WO 2008089914 A1 discloses a hearing aid with a microphone arrangement for receiving acoustic signals to be amplified. The hearing aid comprises at least two earpieces for emitting acoustic signals in different frequency ranges, and at least one signal connection for connecting the microphone arrangement to the earpieces.

U.S. Pat. No. 6,072,885 A discloses a hearing aid system comprises an input transducer for converting acoustical information at an input to electrical signals at an output, an output transducer for converting electrical signals at an input to acoustical information at an output and a plurality of band-pass filters. The band-pass filters have an input connected to the output of the transducer. It is disclosed that the hearing aid system may comprise a plurality of Automatic gain control (AGC) circuits and that the band-pass filters and AGC circuits may be divided into two processing channels, one for low frequencies and one for high frequencies and may drive separate audio transducers, one configured for maximum efficiency at low frequencies and one configured for maximum efficiency at high frequencies.

None of these documents provide a solution that solves the problem of inefficient energy transfer associated with the use of transcutaneous systems.

Thus, there is need for a transcutaneous active bone anchored hearing aid device that is more effective than the prior art transcutaneous active bone anchored hearing aid devices.

Accordingly, it is also an object of the present disclosure to provide a transcutaneous active bone anchored hearing aid device that is more effective than the prior art transcutaneous active bone anchored hearing aid devices.

SUMMARY

The object of the present disclosure can be achieved by a transcutaneous active bone anchored hearing aid device as defined in claim 1 and by a method as defined in claim 15. Preferred embodiments are defined in the dependent sub claims and explained in the following description and illustrated in the accompanying drawings.

The transcutaneous active bone anchored hearing aid device according to the disclosure is a transcutaneous active bone anchored hearing aid device comprising:

- an audio processor comprising means for being externally worn by a hearing aid user,
- an implantable part comprising transducer means for providing a structure-borne acoustic signal to the skull bone of the hearing aid user, The implantable part comprises a low frequency vibrator and a high frequency vibrator arranged next to each other.

Hereby it is possible to provide a transcutaneous active bone anchored hearing aid device that is more effective than the prior art transcutaneous active bone anchored hearing aid devices.

By having a transcutaneous active bone anchored hearing aid device according to the disclosure the maximum force output has a sufficient magnitude over the whole hearing frequency range (from about 200 Hz to about 8 kHz).

The transcutaneous active bone anchored hearing aid device according to the disclosure comprises an audio processor comprising means for being externally worn by a hearing aid user. The audio processor may be an audio processor of any suitable type and size. It is preferred that the audio processor is as small as possible as long as it is capable of being attached to the skin of the user of the hearing aid device by means of magnetic attraction and at the same time is capable of transmitting a signal through electromagnetic induction between an externally worn audio processor and the implantable part.

The implantable part comprises transducer means for providing a structure-borne acoustic signal to the skull bone of the hearing aid user. The structure-borne acoustic signal is a signal that can be transmitted into the bone, into the skull, and to the cochlea (preferably both *cochleae*) bypassing the outer and middle ear.

The implantable part comprises a low frequency vibrator and a high frequency vibrator arranged next to each other. The low frequency vibrator and the high frequency vibrator may be any suitable type of electromechanical vibrator. However, it is preferred that the electromechanical vibrators have a small area and a small thickness.

It may be useful that the transcutaneous active bone anchored hearing aid device comprises a vibrator housing, and that the low frequency vibrator and a high frequency vibrator are arranged in the vibrator housing.

The use of a vibrator housing makes it possible to attach both the low frequency vibrator and the high frequency vibrator in the same depth and thus having the same distance from ipsilateral cochlea, which is the one of the patient's two cochlear organs closest to the vibrator housing. In this way it is possible to achieve equal conditions for both the low frequency vibrator and a high frequency vibrator regarding transmission of mechanical vibrations through the bone structure.

It may be beneficial that the hearing aid device comprises a magnet housing comprising a magnet and a coil, and that the magnet is adapted to provide a magnetic field sufficiently large to keep the audio processor attached to the skin of the hearing aid user, when the implantable part has been implanted into the tissue between the skin and the skull bone of the hearing aid user.

Hereby it is possible to use the link between the externally worn audio processor and the implanted part to transfer signals (energy) through the skin in an effective manner throughout the hearing frequency range (200 Hz-8 kHz).

It may be useful that the audio processor comprises an external magnet for attaching the audio processor to the skin by means of magnetic attraction between the external magnet of the audio processor and the magnet of the magnet housing.

Hereby it is possible to attach an externally worn audio processor to the skin of the hearing aid user by means of a magnet within the audio processor. The magnet of the externally worn audio processor is referred to as the "external" magnet, as it is externally with respect to the user of the device.

It may be beneficial that the low frequency vibrator and the high frequency vibrator comprise a basically circular body member comprising a coil.

By using such a construction it is possible to provide a body member of minimum size, so that the extension of the low frequency vibrator and the high frequency vibrator can be minimized.

This may be useful since the low frequency vibrator and the high frequency vibrator have to be implanted under the skin.

It may be useful that the implantable part comprises a demodulator extending between the magnet housing and the vibrators.

Hereby it is possible to provide a reliable and implantable part having such a flat structure that it can be implanted under the skin of the hearing aid user.

It may be beneficial that the implantable part comprises a side housing extending between the magnet housing and the vibrator housing and that the demodulator is arranged in the side housing.

Hereby the demodulator can be protected from the tissue surrounding the implanted part.

It may be useful that the low frequency vibrator and the high frequency vibrator are driven in parallel.

It may be useful that a capacitor is arranged in series with the high frequency vibrator.

Hereby it is possible to cut off the current consumption of the high frequency vibrator in the low frequency range.

It may be beneficial that the resonance frequency of the high frequency vibrator is within the range 1000-4000 Hz, preferably within the range 1500-3500 Hz, such as 2000-3000 Hz.

Hereby it is possible to provide a transcutaneous active bone anchored hearing aid device that is optimized to work over the whole hearing frequency range (about 200 Hz-8 kHz) and capable of providing a vibrator force of sufficient magnitude throughout the entire hearing frequency range.

It may be useful that the area of the magnet housing is significantly larger than the area of the vibrator housing.

Hereby it is possible to provide a firm attachment of the audio processor to the skin of the hearing aid user and at the same time minimise the size of the magnet housing of the implanted part.

It may be useful that the audio processor comprises a dual-microphone array and noise reducing means.

Hereby it is possible to provide the hearing aid user with the most optimal sound experience.

It may be beneficial that the implantable part comprises an attachment magnet centrally arranged in a basically cylindrical magnet housing.

Such construction makes it easy to arrange a circular coil and a magnet in the magnet housing. Furthermore, the cylindrical shape of the magnet housing makes it possible to provide an easy and user-friendly attachment of the audio processor to the skin.

It may be useful that the attachment magnet is cylindrical or disk-shaped (having a circular cross-section) and fits into the cylindrical magnet housing.

It may be useful that the magnet is surrounded by a circular coil. The coil is concentrically arranged as well in the magnet housing as with respect to the magnet.

Hereby it is possible to provide a very compact implantable part.

It may be useful that the low frequency vibrator and the high frequency vibrator are arranged in such a distance to the bone structure that they are capable of transferring mechanical vibrations to the user's inner ears through the bone structure of the head of the hearing aid user.

Hereby the transfer of mechanical vibrations can be performed in the most suitable way.

It is preferred that the low frequency vibrator and the high frequency vibrator are arranged in a very small distance to the bone structure.

It may be useful that the frequency vibrator and the high frequency vibrator are in mechanical contact with the bone structure.

The objects of the disclosure can be achieved by a method for implanting an implantable part of a hearing aid device, which method comprises the step of attaching a magnet under the skin of a hearing aid user, which method moreover comprises the step of inserting transducer means for providing a structure-borne acoustic signal to the skull bone of the hearing aid user, where the method comprises the step of implanting a low frequency vibrator and a high frequency vibrator arranged next to each other and that the low frequency vibrator and the high frequency vibrator are arranged in such a short distance to the bone structure that they are capable of transferring mechanical vibrations to the user's inner ears through the bone structure of the head of the hearing aid user.

Hereby it is possible to provide a transcutaneous active bone anchored hearing aid device that is more effective than the prior art transcutaneous active bone anchored hearing aid devices.

In the present context, a "hearing aid device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

A "hearing aid device" further refers to a device such as an earphone or a headset adapted to receive audio signals electronically, possibly modifying the audio signals and providing the possibly modified audio signals as audible signals to at least one of the user's ears. Such audible acoustic signals are transferred as mechanical vibrations to the user's inner ears through the bone structure of the user's head and/or through parts of the middle ear.

A hearing aid device may be configured to be worn as a partly implanted unit. A hearing aid device may comprise a single unit or several units communicating electronically with each other.

More generally, a hearing aid device comprises an input transducer for receiving an acoustic signal from a user's surroundings and providing a corresponding input audio signal and/or a receiver for electronically receiving an input audio signal, a signal processing circuit for processing the input audio signal and an output means for providing an audible signal to the user in dependence on the processed audio signal.

Some hearing aid devices may comprise multiple input transducers, e.g. for providing direction-dependent audio signal processing. In some hearing aid devices, the receiver may be a wireless receiver. In some hearing aid devices, the receiver may be e.g. an input amplifier for receiving a wired signal.

In some aid hearing devices, an amplifier may constitute the signal processing circuit. In the hearing aid devices according to the disclosure, the output means comprises an output transducer formed as a vibrator for providing a structure-borne or liquid-borne acoustic signal.

The hearing aid device according to the disclosure comprises a vibrator member that is adapted to provide a structure-borne acoustic signal transcutaneously to the skull bone.

The hearing aid device according to the disclosure may be a "hearing system" referring to a system comprising one or two hearing aid devices. A "binaural hearing system" refers to a system comprising one or two hearing aid devices that is being adapted to cooperatively provide audible signals to both of the user's ears.

The hearing aid device according to the disclosure may be a "hearing system" or binaural hearing system comprising "auxiliary devices", which communicate with the hearing aid devices and affect and/or benefit from the function of the hearing aid devices. Auxiliary devices may be e.g. remote controls, remote microphones, audio gateway devices, mobile phones, public-address systems, car audio systems or music players.

Hearing aid devices, hearing systems or binaural hearing systems may e.g. be used for compensating for a hearing-impaired person's loss of hearing capability, augmenting or protecting a normal-hearing person's hearing capability and/or conveying electronic audio signals to a person.

DESCRIPTION OF THE DRAWINGS

The disclosure will become more fully understood from the detailed description given herein below. The accompanying drawings are given by way of illustration only, and thus, they are not limitative of the present disclosure. In the accompanying drawings:

FIG. 1 B) shows an audio processor of a hearing aid according to the disclosure;

FIG. 2 B) is a graph illustrating the vibrator force as function of frequency of a high frequency vibrator with and without a capacitor;

FIG. 2 C) is a graph illustrating two current curves of a high frequency vibrator with and without a capacitor;

FIG. 3 B) is a graph illustrating three current curves of a single vibrator, a low frequency vibrator and a high frequency vibrator;

FIG. 3 C) is a graph illustrating the current curve of a dual vibrator according to the disclosure and FIG. 4 shows a schematically cross-sectional view of the head of a hearing aid user wearing a hearing aid device according to the disclosure.

DETAILED DESCRIPTION

Figure 1:
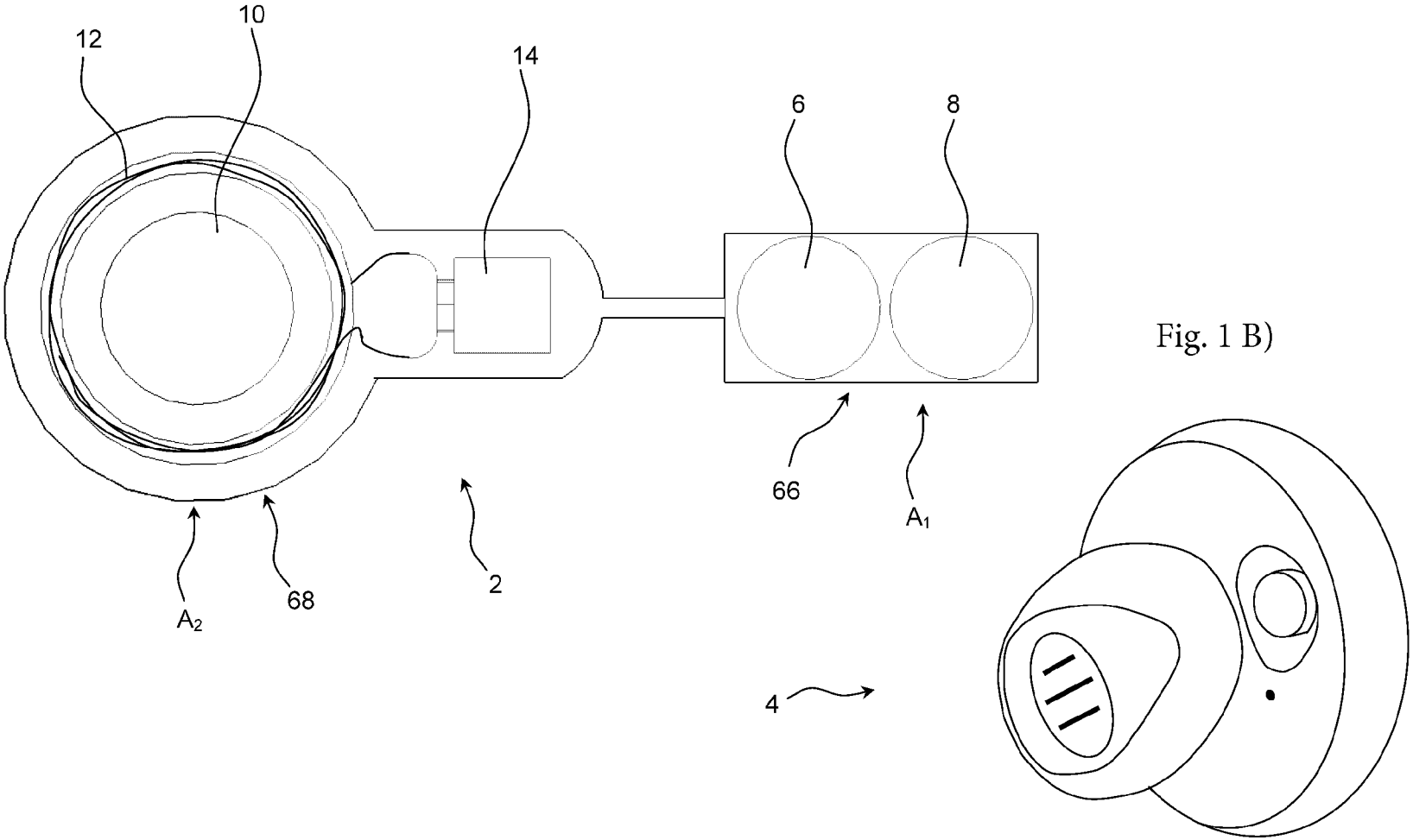
FIG. 1 A) shows an implant according to the disclosure.

Referring now in detail to the drawings for the purpose of illustrating preferred embodiments of the present disclosure, a schematically view of the implantable part 2 of a hearing aid device according to the disclosure is illustrated in FIG. 1 A).

The implantable part 2 comprises two electromechanical vibrators 6, 8. The implantable part 2 comprises a low frequency vibrator 6 and a high frequency vibrator 8 arranged next to each other in a vibrator housing 66. Both the low frequency vibrator 6 and the high frequency vibrator 8 comprise a basically circular body member of similar size.

The implantable part 2 comprises an attachment magnet 10 centrally arranged in a basically cylindrical magnet housing 68. The magnet 10 is surrounded by a circular coil 12 concentrically arranged in the magnet housing 68. The circular coil 12 is concentrically arranged with respect to the magnet 10.

Throughout the description "magnet" is used to designate a body with either permanent or temporary magnetic properties, such that such a body may be attracted to another body comprising magnetic properties. The magnets referred to may be single body magnets with similar magnetic properties throughout the entire body, or they may comprise assemblies of magnets or magnetically attractable units having dissimilar magnetic properties.

A demodulator 14 is arranged in a side housing 70 extending between the magnet housing 68 and the vibrator housing 66. The demodulator 14 is connected to the vibrator housing 66. The area $A_2$ of the magnet housing 68 is significantly larger than the area $A_1$ of the vibrator housing 66. The area $A_2$ of the magnet housing 68 is more than twice as large as the area $A_1$ of the vibrator housing 66.

The implantable part 2 is configured to be placed surgically under the skin next to the skull bone of the hearing impaired person. The magnet 10 is configured to function as an attachment means for attachment of an outer part—the audio processor that is described in the following.

FIG. 1 B) illustrates a schematically perspective view of an audio processor 4 of a hearing aid device according to the disclosure. The audio processor 4 is the "outside part" of the hearing aid device and may comprise a dual microphone solution configured to reduce interference originating from behind and from the sides of the listener.

This may be done by applying a directional mode. Hereby the hearing aid offers the user increased comfort and enhanced listening ability in noisy situations so that the user can understand conversation in the immediate vicinity more clearly and distinctly.

The audio processor 4 is adapted to be externally worn by the hearing impaired user.

The audio processor 4 comprises an external magnet 11 for attachment to the attachment magnet 10 of the implantable part 2. In use, the audio processor 4 is held in place by the magnetic attraction between the magnet 10 of the implantable part 2 and the external magnet 11 of the audio processor 4.

The audio processer 4 comprises at least one microphone (e.g. one microphone array) that picks up sounds from the surroundings of the user of the hearing aid. The audio processor 4 converts these sounds into electrical signals that are transmitted through the skin to the implantable part 2 via an inductive link.

Referring again to FIG. 1 the vibrators 6, 8 are electromechanical vibrators each having a magnetic circuit and a coil. The impedance Z of the coil is given by the following equation [1]:

$$Z=R_{DC}+j\omega L=|Z|e^{j\theta} \quad [1]$$

Where $R_{DC}$ is the DC-resistance of the coil, L is the inductance of the coil and θ is the phase difference between voltage and current, where e is Euler's number (approximately 2.71828), and where j is the imaginary unit (complex numbers).

The resistance $R_{DC}$ proportionates to the wire length l and the inverse of the wire cross section area A and the resistivity $\rho_{Cu}$ of the wire material (in this case copper, Cu). Accordingly, the resistance $R_{DC}$ is given by:

$$R_{DC}=\frac{l\cdot\rho_{Cu}}{A} \quad [2]$$

The inductance L is proportional to the square of the number, n, of turns in the coil. This can be expressed in the following way:

$$L\propto n^2 \quad [3]$$

The impedance, Z, of each of the vibrators 6, 8 is related to the resonance frequency of the electromechanical vibratory system. Each of the vibrators 6, 8 are assumed to behave like a harmonic oscillator. When displaced from its equilibrium position, the system experiences a restoring force, F, proportional to the displacement.

When optimising each of the vibrators 6, 8 the counterweight mass, m, the vibrator spring constant, k, the number of turns, n, in the coil and the cross-sectional area, A, may be varied:

When optimising a single vibrator 6, 8 the resonance frequency is typically selected to be approximately 800-900 Hz. The number of turns, n, in the coil, the wire length, l, of the coil and the cross section wire area of the coil to match maximum current of the battery. If a given battery has an upper limit of 20 mA for example, the parameters may be chosen so that at maximum voltage output for the hearing aid driver integrated circuit (16 see FIG. 2 A) the vibrator 6, 8 should not consume more than 20 mA. This gives the vibrator 6, 8 both an acceptable performance in the low frequency range and in the high frequency range.

The vibrator efficiency depends on the product between n, of turns in the coil and I, the current.

$$n\cdot I \quad [4]$$

Accordingly, to get good performance in the low frequency range the number of turns has to be high. However, a high number of turns, n, result in a high impedance and thus a poor performance in the high frequency range.

On the other hand, a coil having few turns will have good performance in the high frequency range, but low performance in the low frequency range.

Accordingly, it is difficult to optimize one single vibrator 6, 8 to perform well in the low frequency range and in the high frequency range at the same time. Consequently, there it is a major improvement to apply two vibrators 6, 8, where one of the vibrators 6 is optimized for the low frequency range and where the other vibrator 8 is optimized for HF.

In the percutaneous applications in which the vibrator is arranged on the outside of the skin, the use of two vibrators 6, 8 would be very challenging because of the extension of the vibrators 6, 8. If the vibrators 6, 8 are placed on the top of each other the thickness (height) will be two large. On the other hand, the area of the vibrators 6, 8 will be too large when placed next to each other. Besides, none of the solutions will be cosmetically appealing.

On the other hand, if the two vibrators 6, 8 are implanted and placed next to each other, they can be hidden under the skin provided that the thickness (height) of the vibrators 6, 8 can be kept small.

Figure 2:
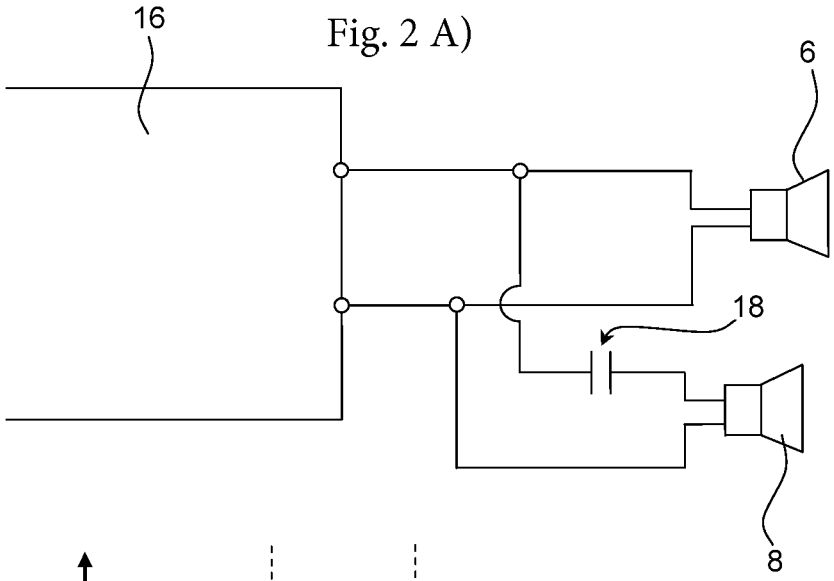
FIG. 2 A) shows a schematically diagram of a dual vibrator according to the disclosure.
Figure 2:
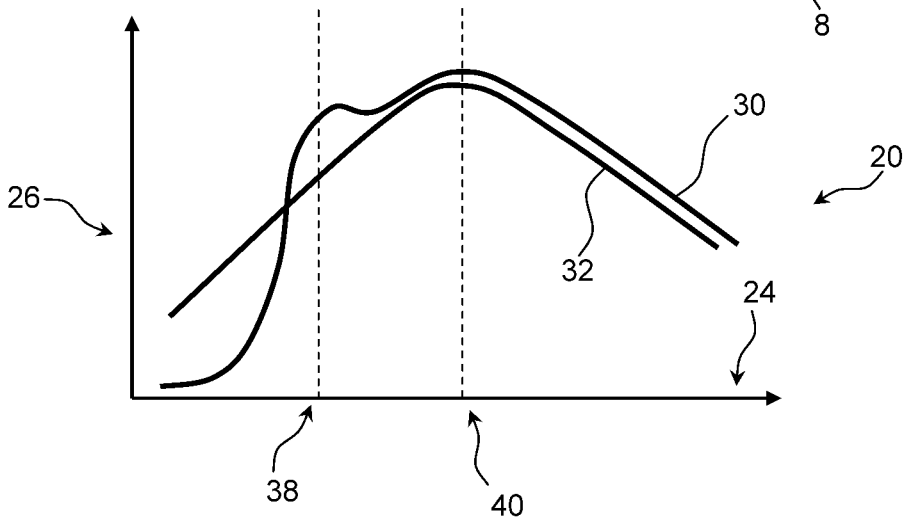
Figure 2:
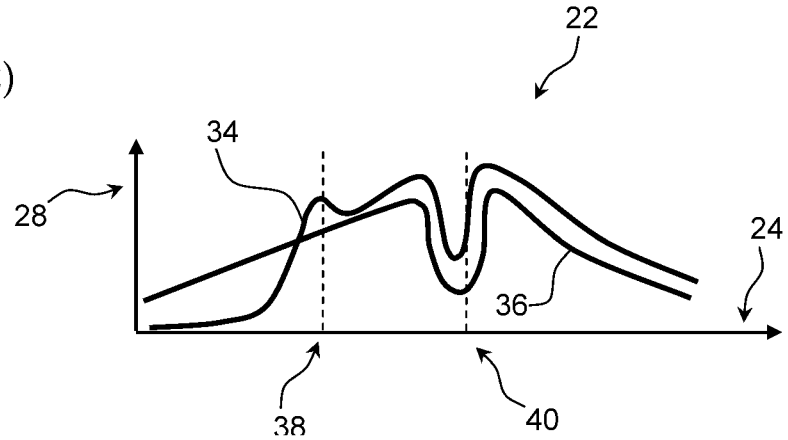

FIG. 2 A) illustrates a schematically diagram of a dual vibrator according to the disclosure. The dual vibrator comprises a low frequency vibrator 6 and a high frequency vibrator 8. Both vibrators 6, 8 are electrically connected to a driver integrated circuit 16. Since the low frequency vibrator 6 and the high frequency vibrator 8 are driven in parallel, it is of great importance to cut off the current consumption of the high frequency vibrator in the low frequency range. This is done by arranging a capacitor 18 in series with the high frequency vibrator 8.

Hereby it is achieved that the current is effectively cut off for the low frequencies. The capacitor 18 in series with the high frequency vibrator 8 creates a LC circuit with a resonant frequency ω given by:

$$\omega=\frac{1}{\sqrt{LC}}, \quad [5]$$

where L is the inductance and C is the is the capacitance.

The LC circuit is capable of storing electrical energy oscillating at its resonant frequency ω. This "resonance effect" takes place when the magnitude of the inductive and capacitive reactances are equal.

This "resonance effect" can be applied to boost the curve in-between the low frequency vibrator resonance and the high frequency vibrator resonance i.e. smoothing out the dip in output curve (see the curve 30 in FIG. 2 B).

FIG. 2 B) shows a graph 20 illustrating the vibrator force 26 as function of frequency 24. The vibrator force 26 is measured in dB μN. A first frequency 38 corresponding to 900 Hz and a second frequency 40 corresponding to 2500 Hz are indicated with vertical dotted lines.

The graph 20 contains two curves 30, 32. The first curve 30 depicts the vibrator force 26 versus frequency 24 for the capacitor 18 placed in series with the high frequency vibrator 8. The second curve 32 depicts the vibrator force 26 versus frequency 24 for a high frequency vibrator 8 with no capacitor 18 in series with the high frequency vibrator 8.

FIG. 2 C) shows a graph 22 illustrating two current curves 34, 36, where the current 28 (e.g. measured in units of mA) is depicted as function of frequency 24. The curve 34 depicts the current curve of a high frequency vibrator 8 with a capacitor 18 (the capacitor 18 is placed in series with the high frequency vibrator 8). The curve 36 depicts the current curve of a high frequency vibrator 8 without a capacitor.

A first frequency 38 corresponding to 900 Hz and a second frequency 40 corresponding to 2500 Hz are indicated with vertical dotted lines.

In the low frequency range the curve 34 takes close-to-zero values. Hereby, it is possible to cut off the current consumption 28 of the high frequency vibrator 8 in the low frequency range below the frequency 38.

Figure 3:
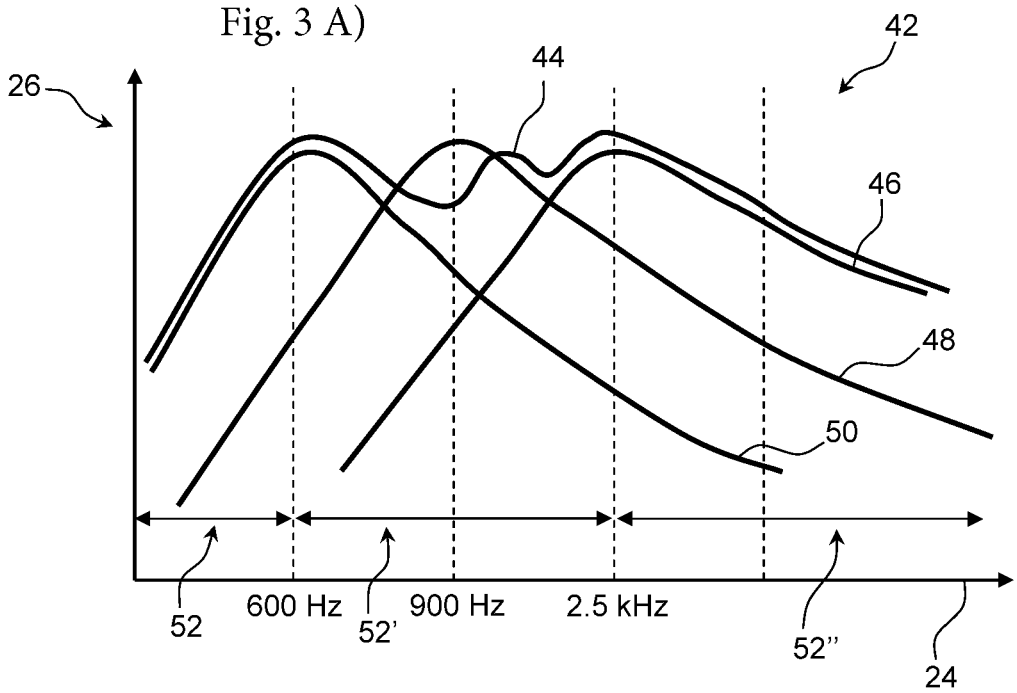
FIG. 3 A) is a graph illustrating a single vibrator, a low frequency vibrator, a high frequency vibrator and a dual vibrator force curves as function of frequency.
Figure 3:
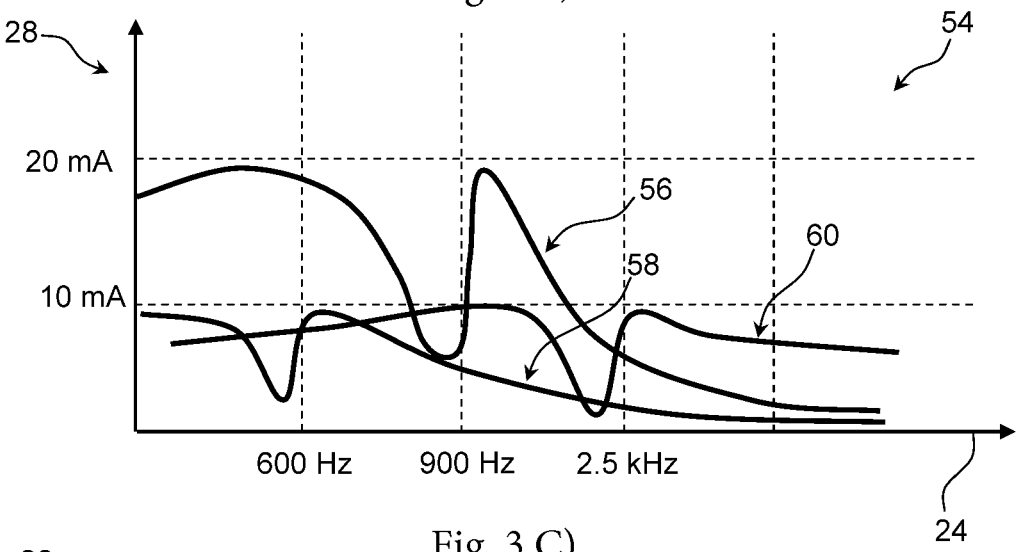
Figure 3:
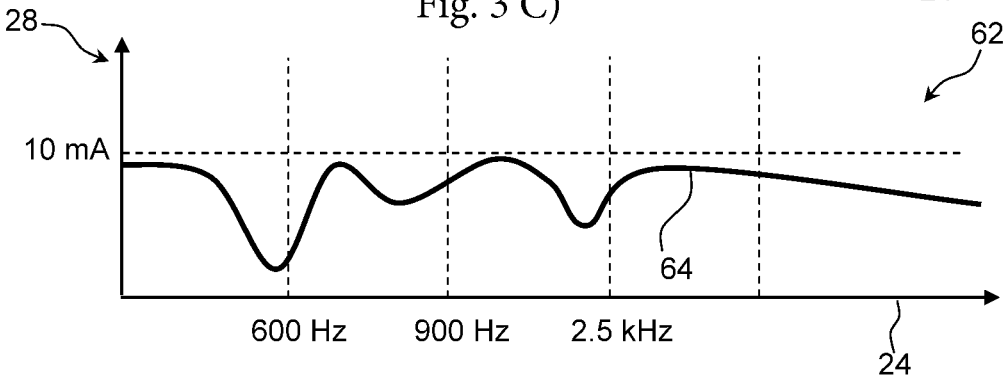

FIG. 3 A) shows a graph 42 illustrating different vibrator force curves 44, 46, 48, 50 as function of frequency 24. The vibrator force 26 is measured in dB μN and three frequency areas 52, 52', 52" are indicated. Moreover the frequencies corresponding to 600 Hz, 900 Hz and 2.5 kHz are indicated with vertical dotted lines.

The curve 48 illustrates the vibrator force 26 versus frequency 24 for a (prior art) single vibrator solution. It can be seen that the vibrator force 26 is low both in the first frequency area 52 and in the third frequency area 52".

The curve 50 illustrates the vibrator force 26 of a low frequency vibrator of a hearing aid according to the disclosure. The vibrator force 26 is depicted versus frequency 24. It can be seen that the vibrator force 26 is significantly higher than the curve 48 in the first frequency area 52, but very low in the third frequency area 52".

The curve 46 illustrates the vibrator force 26 of a high frequency vibrator of a hearing aid according to the disclosure. The vibrator force 26 is depicted versus frequency 24. It can be seen that the vibrator force 26 is lower than both of the curves 48, 50, in the first frequency area 52, however, in the third and high frequency area 52" is the vibrator force 26 significantly larger than both of the curves 48, 50.

The curve 44 illustrates the vibrator force 26 of a dual vibrator hearing aid according to the disclosure. The vibrator force 26 is depicted versus frequency 24 and it can be seen that a large vibrator force 26 is achieved in both the first frequency area 52, the second frequency area 52' and in the third frequency area 52".

Therefore, the hearing aid according to the disclosure is capable of transferring signals through the skin in an efficient manner. Accordingly, a reliable and operable hearing aid can be achieved.

The first frequency area 52 includes frequencies up to 600 Hz and represents the low frequency area—an area in which the vibrators are not in phase.

The second frequency area 52' extends from 600 Hz to 2.5 kHz. The vibrators are in phase in this frequency area 52'.

The third and high frequency area 52" extends above 2.5 kHz. The vibrators are not in phase in the third frequency area 52".

FIG. 3 B) shows a graph 54 illustrating three current curves 56, 58, 60. The graph 54 depicts current 28 versus frequency 24. The first curve 56 shows the current curve of a (prior art) single vibrator.

The second curve 58 shows the current curve of a low frequency vibrator according to the disclosure. The third curve 60 shows the current curve of a high frequency vibrator according to the disclosure.

The first frequency area 52, the second frequency area 52' and the third frequency area 52" are shown in FIG. 3 A) are also shown in FIG. 3 B).

Moreover, the like in FIG. 3 A), the frequencies corresponding to 600 Hz, 900 Hz and 2.5 kHz are indicated with vertical dotted lines.

FIG. 3 C) shows a graph 62 illustrating the current curve 64 (current 28 versus frequency 24) of a dual vibrator according to the disclosure. The graph 62 contains the frequencies 600 Hz, 900 Hz and 2.5 kHz indicated with vertical dotted lines in the same way as in FIG. 3 A) and in FIG. 3 B). When compared to FIG. 3 B), it can be seen that the current curve 64 shown in FIG. 3 C) varies much less than the current curve 56 of a (prior art) single vibrator.

Figure 4:
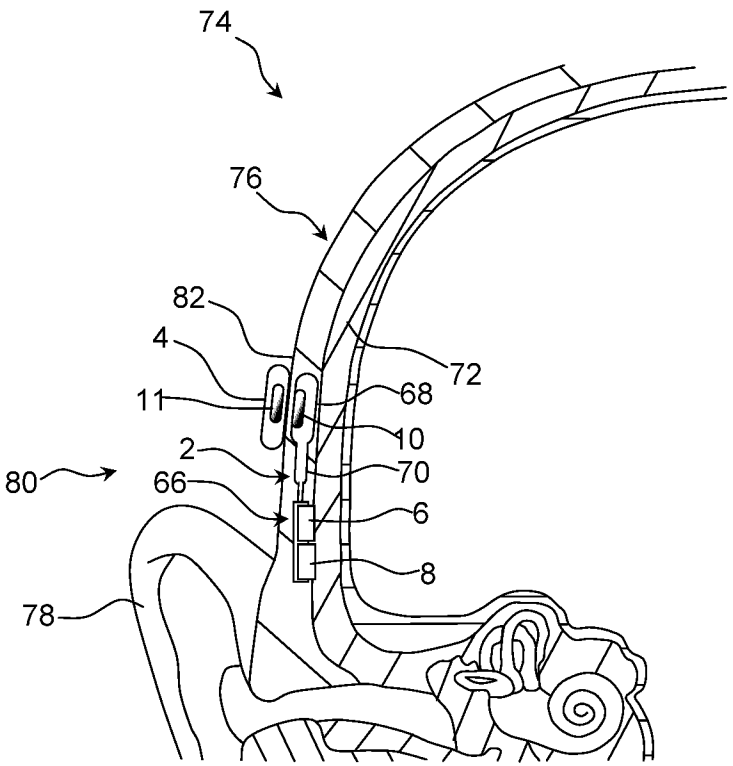

FIG. 4 illustrates a schematically cross-sectional view of the head 76 of a hearing aid user 74 wearing a hearing aid device 80 according to the disclosure. The hearing aid device 80 comprises an audio processer 4 that is attached to the skin 82 above the ear 78 of the hearing aid user 74.

The hearing aid device 80 comprises an implantable part 2 consisting of a housing 68 having a magnet 10 that is not visible but can be seen in FIG. 1 A). The audio processer 4 comprises an external magnet 11 that is attracted to the magnet 10 within the magnet housing 68 of the implantable part 2 of the hearing aid device 80. Accordingly, the audio processer 4 is detachably attached to the skin 82 by means of magnetic attraction between the magnets within the magnet housing 68 and within the audio processer 4. The implantable part 2 is implanted in the tissue between the skin 82 and the skull bone 72.

The implantable part 2 of the hearing aid device 80 comprises a vibrator housing 66 with a low frequency vibrator 6 and a high frequency vibrator 8 arranged to provide a structure-borne acoustic signal transcutaneously to the skull bone 72. A modulator (shown in FIG. 1 A) is arranged in a side housing 70 extending between the magnet housing 68 and the vibrator housing 66. The modulator is connected to the vibrator housing 66.

The hearing aid device 80 according to the disclosure provides an alternative to the prior art hearing aid devices—an alternative that is cosmetically appealing and is reliable.

LIST OF REFERENCE NUMERALS

2 Implantable part
4 Audio processor
6 Low frequency vibrator
8 High frequency vibrator
10 Magnet
11 External magnet
12 Coil
14 Demodulator
16 Driver integrated circuit
18 Capacitor
20, 22 Graph
24 Frequency
26 Force [dB μN]
28 Current [mA]
30, 32, 34, 36 Curve

38 First frequency
40 Second frequency
42 Graph
44, 46, 48, 50 Curve
52, 52', 52" Frequency area
54 Graph
56, 58, 60 Curve
62 Graph
64 Curve
66, 68, 70 Housing
72 Bone
74 Hearing aid user
76 Head
78 Ear
80 Hearing aid device
82 Skin

The invention claimed is:

1. A transcutaneous active bone anchored hearing aid device, comprising:

an external an audio processor configured to be externally worn by a hearing aid user;

an implantable part comprising a transducer device configured to provide a structure-borne acoustic signal to the skull bone of the hearing aid user, the transducer device including a low frequency vibrator and a high frequency vibrator arranged next to each other, wherein each of the low frequency vibrator and the high frequency vibrator includes a substantially circular body member comprising a coil having a number of turns, and the number of turns in the coil of the low frequency vibrator is greater than the number of turns in the coil of the high frequency vibrator.

2. A transcutaneous active bone anchored hearing aid device according to claim 1, wherein the hearing aid device comprises a vibrator housing, and the low frequency vibrator and high frequency vibrator are arranged in the vibrator housing.

3. A transcutaneous active bone anchored hearing aid device according to claim 2, wherein the implantable part comprises a magnet housing to house a magnet, and the area of the magnet housing is significantly larger than the area of the vibrator housing.

4. A transcutaneous active bone anchored hearing aid device according to claim 2, wherein the hearing aid device comprises a magnet housing comprising a magnet and a coil, and the magnet is adapted to provide a magnetic field sufficiently large to keep the audio processor attached to the skin of the hearing aid user, when the implantable part has been implanted into the tissue between the skin and the skull bone of the hearing aid user.

5. A transcutaneous active bone anchored hearing aid device according to claim 1, wherein implantable part comprises a magnet housing comprising a magnet and a coil, and the magnet is adapted to provide a magnetic field sufficiently large to keep the audio processor attached to the skin of the hearing aid user, when the implantable part has been implanted into the tissue between the skin and the skull bone of the hearing aid user.

6. A transcutaneous active bone anchored hearing aid device according to claim 5, wherein the audio processor comprises an external magnet for attaching the audio processor to the skin by means of magnetic attraction between the external magnet of the audio processor and the magnet of the magnet housing.

7. A transcutaneous active bone anchored hearing aid device according to claim 5, wherein the implantable part comprises a demodulator extending between the magnet housing and the vibrators.

8. A transcutaneous active bone anchored hearing aid device according to claim 7, wherein the hearing device comprises a vibrator housing, the low frequency vibrator and the high frequency vibrator are arranged in the vibrator housing, the implantable part comprises a side housing extending between the magnet housing and the vibrator housing, and the demodulator is arranged in the side housing.

9. A transcutaneous active bone anchored hearing aid device according to claim 5, wherein the magnet of the implantable part is centrally arranged in the magnet housing, which is a basically cylindrical magnet housing.

10. A transcutaneous active bone anchored hearing aid device according to claim 9, wherein the magnet of the implantable part is surrounded by the coil, which is a circular coil concentrically arranged in the magnet housing and with respect to the magnet.

11. A transcutaneous active bone anchored hearing aid device according to claim 1, wherein a capacitor is arranged in series with the high frequency vibrator.

12. A transcutaneous active bone anchored hearing aid device according to claim 1, wherein the resonance frequency of the high frequency vibrator is within the range 1000-4000 Hz.

13. A transcutaneous active bone anchored hearing aid device according to claim 1, wherein the audio processor comprises a dual-microphone array and noise reduction unit.

14. A transcutaneous active bone anchored hearing aid device according to claim 1, wherein the low frequency vibrator and the high frequency vibrator are arranged in such a distance to the bone structure that they are capable of transferring mechanical vibrations to the user's inner ears through the bone structure of the head of the hearing aid user.

15. A method for implanting an implantable part of a hearing aid device, the method comprising:

attaching a magnet under the skin of a hearing aid user;

inserting a transducer device configured to provide a structure-borne acoustic signal to the skull bone of the hearing aid user; and implanting a low frequency vibrator and a high frequency vibrator arranged next to each other, wherein the low frequency vibrator and the high frequency vibrator are arranged in such a distance to the bone structure that they are capable of transferring mechanical vibrations to the user's inner ears through the bone structure of the head of the hearing aid user, each of the low frequency vibrator and the high frequency vibrator includes a substantially circular body member comprising a coil having a number of turns, and the number of turns in the coil of the low frequency vibrator is greater than the number of turns in the coil of the high frequency vibrator.

* * * * *